US006123809A

United States Patent [19]

Devenyns et al.

[11] Patent Number: 6,123,809

[45] Date of Patent: Sep. 26, 2000

[54] METHOD FOR BLEACHING PAPER PULP

[75] Inventors: Johan Devenyns, Asse; Eric Chauveheid, Brussels; Lucien Plumet, Vilvoorde, all of Belgium

[73] Assignee: Solvay Interox (Societe Anony.), Belgium

[21] Appl. No.: 09/254,495

[22] PCT Filed: Aug. 23, 1997

[86] PCT No.: PCT/EP97/04758

§ 371 Date: Apr. 15, 1999

§ 102(e) Date: Apr. 15, 1999

[87] PCT Pub. No.: WO98/11295

PCT Pub. Date: Mar. 19, 1998

[30] Foreign Application Priority Data

| | | | |
|---|---|---|---|
| Sep. 11, 1996 | [BE] | Belgium | 09600764 |
| Oct. 11, 1996 | [BE] | Belgium | 09600857 |
| Oct. 11, 1996 | [BE] | Belgium | 09600858 |

[51] Int. Cl.[7] ..... D21C 9/10; D21C 9/12; D21C 9/14; D21C 9/153; D21C 9/16

[52] U.S. Cl. ..... 162/65; 162/72; 162/76; 162/78; 162/88; 162/89

[58] Field of Search ..... 162/76, 78, 65, 162/72, 88, 89, 82

[56] References Cited

U.S. PATENT DOCUMENTS

| | | | |
|---|---|---|---|
| 5,462,641 | 10/1995 | Bergvist et al. | 162/76 |
| 5,571,378 | 11/1996 | Elofson et al. | 162/76 |
| 5,741,398 | 4/1998 | Germgard et al. | 162/76 |

*Primary Examiner*—Steve Alvo
*Attorney, Agent, or Firm*—Larson & Taylor, PLC

[57] ABSTRACT

A process for the delignification and bleaching of chemical pulp utilizes an acid treatment stage aimed at reducing the quantity of hexene uronic acids present in the pulp by at least 30%, and a pH adjustment stage of the pulp aimed at depositing or redepositing ions of alkaline-earth metals on the fibres of the pulp. The process further includes a washing stage of the pulp and a treatment stage of the pulp with an oxidizing agent. A chelating agent is added to the pulp before and/or during the acid treatment stage and/or before or during the pH adjustment stage or between the pH adjustment stage and washing stage.

17 Claims, 4 Drawing Sheets

METHOD FOR BLEACHING PAPER PULP

FIELD OF THE INVENTION

The present invention relates to a process for the delignification and bleaching of chemical pulps.

BACKGROUND OF THE INVENTION

The manufacture of chemical pulp comprises two main phases, namely a phase involving the cooking of lignocellulosic materials by means of chemical reagents intended to dissolve the greater part of the lignin and to release the cellulosic fibres, leading to an unbleached pulp, a phase involving the delignification and bleaching of the unbleached pump, comprising in general several successive treatment stages interspersed in some cases with washing, dilution and/or concentration stages in order to achieve the residual lignin content and the whiteness that are desired.

The term chemical pulps will be taken to mean pulps which have undergone a delignification treatment in the presence of chemical reagents such as sodium sulphide in an alkaline medium (kraft or sulphate cooking) or else by other alkaline processes.

In recent years, numerous delignification and bleaching processes free from chlorine have been developed in addition to those which conventionally use chlorine and chlorine dioxide. Various kinds of delignification and bleaching agents are currently used for the treatment of the unbleached pulps. For example, it has been proposed that the chemical pulps be subjected to the action of oxygen in an alkaline medium, and then to delignification and bleaching treatments comprising treatments with ozone, peracids and hydrogen peroxide.

When chemical pulps are bleached with oxidizing agents such as ozone, peracids or hydrogen peroxide, it is advisable to remove from the pulp certain harmful metal ions. These metal ions having a harmful effect are ions of transition metals and include, among others, manganese, copper and iron, which catalyse decomposition reactions of the peroxidized reagents. They degrade the peroxidized reagents employed for the delignification and the bleaching via radical-type mechanisms and thus increase the consumption of these products while at the same time reducing the mechanical properties of the pulp.

Removal of the metal ions can be effected by a treatment with acid at the ambient temperature of the pulp. However, these treatments in an acid medium remove not only the harmful metal ions but also the ions of alkaline-earth metals such as magnesium and calcium, which have a stabilizing effect on the peroxidized reagents employed and a beneficial effect on the visual and mechanical qualities of the pulp.

It has been found recently that in chemical pulps, the metal ions are above all linked to carboxylic acid groups. Thus, the PCT patent application WO 96/12063 proposes a method for destroying selectively 4-deoxy-b-L-threo-hex-4-ene pyranosyluronic acid groups (hexene uronic groups) by treating the pulp at a temperature of between 85° C. and 150° C. and at a pH of between 2 and 5. The destruction of the hexene uronic groups reduces the kappa number from 2 to 9 units and reduces in a non-selective manner the adsorption of the ions of transition metals and alkaline-earth metals.

One of the major disadvantages of these processes in an acid medium is therefore that they are not selective with respect to certain metal ions, namely with respect to the harmful ions of transition metals.

A known means of selectively removing harmful metal ions from the pulp consists in the chelation of these ions. Unfortunately, this chelation stage requires a strict monitoring of the pH of the pulp often in a pH range which is close to neutral. Patent application EP 0 456 626 describes a pulp bleaching process in which a chelation stage (stage Q) is carried out in a pH range of between 3.1 and 9.0 before the treatment of the pulp with hydrogen peroxide (stage P). However, example 1 of this patent application shows that the maximum whiteness of the pulp after treatment with the peroxide comes to 66.1° ISO and that this is achieved when the pH of stage Q is equal to 6.1. At higher pH values, the whiteness of the pulp declines rapidly and reaches not more than 51.9° ISO at pH 7.7 and 56.4° ISO at pH 9.1. It follows from this example that it is possible in theory to carry out a chelation stage in a broad pH range but that in practice the pH zone in which satisfactory results are obtained is very restricted and often close to neutral pH values where the buffer capacity of the pulp suspension is weak and in which the monitoring of the pH is difficult. As soon as the optimum pH value is departed from, in fact, the paper quality drops very sharply, so that the process requires strict monitoring of the pH. The pH optimum of the chelation depends on the pulp employed and lies for current chemical pulps in a pH range of between 4 and 7. However, each pulp has a specific optimum pH within this pH range of between 4 and 7 for stage Q. As soon as this optimum pH is departed from, the pulp quality obtained after treatment with hydrogen peroxide declines rapidly. In addition, the quantity of hydrogen peroxide consumed increases together with the production costs. In other words, even a small variation in the pH during stage Q has a considerable influence on the quality and/or the cost price of the chemical pulp. In industrial applications, it is difficult to monitor accurately the pH when the latter is close to neutrality, because the buffer capacity of the pulp suspension is relatively weak.

Furthermore, the known means of selectively removing harmful metal ions from the pulp, i.e. the chelation of these ions, requires the use of strong chelating agents. Patent application EP 0 456 626 describes a pulp bleaching process in which a chelation stage (stage Q) using aminocarboxylic chelating agents such as EDTA or DTPA is carried out in a pH range of between 3.1 and 9.0 before the treatment of the pulp with hydrogen peroxide (stage P).

One disadvantage of this process is linked to the use of very strong aminocarboxylic chelating agents such as ethylenediaminetatra-acetic acid (EDTA) of diethylenetriaminepenta-acetic acid (DTPA). As the pulp itself possesses sequestrating properties for ions of transition metals, it is in fact necessary to use appreciable quantities of aminocarboxylic chelating agents in order to remove these ions from the pulp. Moreover, it is necessary to use very strong aminocarboxylic chelating agents in order to remove these ions from the pulp. Other less powerful chelating agents have no effect on the ions which it is desired to remove. However, the use of aminocarboxylic chelating agents raises problems with regard to environmental protection. Since they are biodegradable to only a limited extent, they are difficult to destroye in conventional water treatment stations and some of them end up in rivers. These chelating agents can then solubilise heavy metals such as the mercury and cadmium contained in the sediments of these rivers and introduce them into the food chain.

SUMMARY OF THE INVENTION

The aim of the present invention is to propose a process for the delignification and bleaching of chemical pulp which makes it possible to broaden the effective pH zone of the chelation (stage Q) prior to a treatment with an oxidizing agent, without affecting the whiteness of the pulp.

To this end, the invention relates to a process for the delignification and bleaching of chemical pulp comprising in this order:

a) an acid treatment stage of the pulp in order to reduce by at least 10% the quantity of hexene uronic acids present in the pulp, b) a pH adjustment stage of the pulp in order to deposit or re-deposit ions of alkaline-earth metals on the pulp, c) a washing stage of the pulp, d) a treatment stage of the pulp with an oxidizing agent, together with at least one addition of a chelating agent to the pulp carried out before the acid treatment stage (a), during the acid treatment stage (a), before the pH adjustment stage (b), during the pH adjustment stage (b) and/or after the pH adjustment stage (b).

It is no longer necessary to monitor strictly the pH of the pulp during its treatment with a chelating agent. In other words, even if the pH of the pulp varies during the chelation, the result, that is to say the whiteness of the pulp obtained after the treatment stage with an oxidizing agent, is not affected. During the chelation the pH can even be greater than 8, in particular greater than 9. Generally, the pH is lower or equal to 12.

One of the advantages of this process is that the consumption of oxidizing agent required to obtain a pulp having a specified degree of whiteness virtually no longer depends on the pH of the chelation.

The quantity of oxidizing agent consumed remains more or less constant in a broad pH range of the chelation and lies in general at a level lower than that of the known processes.

In addition, the pulp thus treated retains good visual and mechanical properties in a broad pH range of the chelation.

It is important to note that the adjustment of the pH of the suspension of the pulp must take place before the washing stage. During the adjustment of the pH, in fact, ions of alkaline-earth metals such as magnesium and calcium must be deposited or re-deposited on the fibres in order to obtain a high ratio of beneficial ions to harmful ions, that is to say ions of alkaline-earth metals to ions of transition metals, on the fibres. It is particularly important to possess a high ratio of magnesium to manganese on the fibres in order to avoid a catalytic decomposition of the oxidizing agent during the treatment stage with oxidizing agent. This magnesium/manganese ratio on the fibres preferably is above 30.

It is naturally possible to add, if necessary, ions of alkaline-earth metals to the pulp suspension in order to increase the ratio ions of alkaline-earth metals/ions of transition metals on the fibres. If it is desired to increase the magnesium/manganese ratio on the fibres, magnesium may be added to the pulp, preferably before adjusting the pH or in any case before the washing stage (c).

The fact that in the present process an acid treatment stage (a) aimed at reducing the quantity of hexene uronic acids in the pulp is combined with an adjustment of the pH before the washing of the pulp makes it possible to broaden substantially the pH range of the chelation within which it is possible to obtain a pulp of a specified whiteness.

Another advantage of this process is being able to avoid jumps in pH during the treatment of the pulp and thus to reduce the quantity of reagents employed. After the acid treatment stage aimed at reducing the quantity of hexene uronic acids, in fact, the pH of the pulp is adjusted by adding for example a base such as sodium hydroxide, and the pulp is then washed in order to remove the ions of chelated transition metals. The pulp therefore no longer requires to be acidified before the chelation. The quantity of reagent employed at the treatment stage with an oxidizing agent in an alkaline medium is consequently less.

DETAILED DESCRIPTION OF THE PREFERRED EMBODIMENTS

Figure 1:
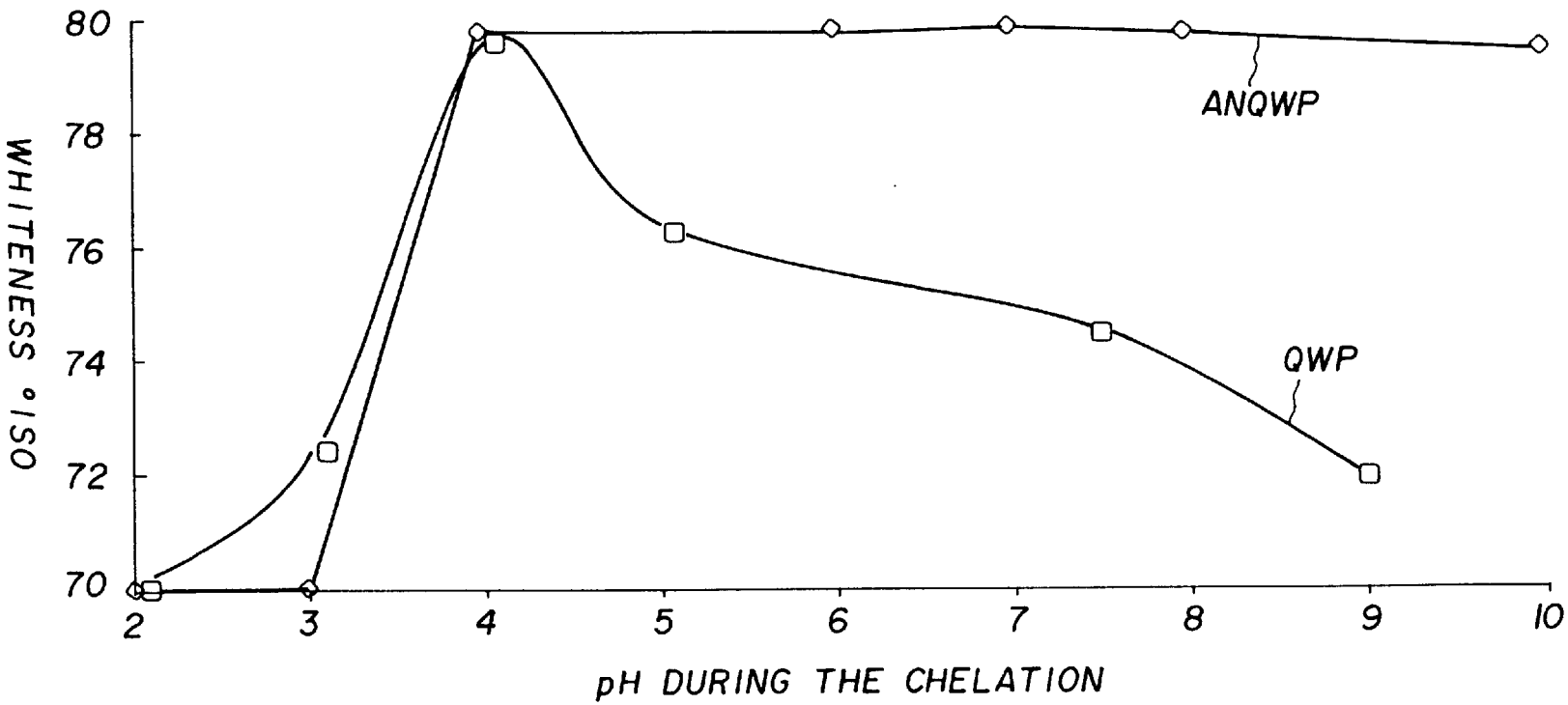
FIG. 1 is a graph showing the whiteness expressed in degrees ISO of a pulp subjected to an A N Q W P treatment and that of a pulp having undergone a conventional Q W P treatment.

According to a first preferred embodiment, the acid treatment stage (a) of the pulp is carried out at a pH greater than about 2. For preference the pH does not exceed 6.5.

The temperature of the acid treatment stage (a) of the pulp is preferably higher than 85° C. It is with advantage less than 150° C.

Various acids such as inorganic acids, for example sulphuric acid, nitric acid, hydrochloric acid, and organic acids such as formic acid and/or acetic acid can be used to regulate the pH of the pulp suspension during the acid treatment stage. If it is desired, the acids can be buffered, for example with the salts of acids such as formates, in order to maintain the pH as constant as possible during the whole of the treatment.

The duration of the acid treatment stage (a) depends on the pH, the temperature and the pulp utilized.

Alternatively, the acid treatment stage (a) of the pulp is carried out in the presence of an oxidizing agent. The acid treatment stage (a) of the pulp in the presence of an oxidizing agent is carried out at a pH higher than about 2. For preference, the pH does not exceed 6.5.

The oxidizing agent during the acid treatment stage (a) with an oxidizing agent can be chosen from among chlorine, chlorine dioxide, ozone, peracids, hydrogen peroxide and their mixtures.

Examples of peracids which can be used in this process are peracetic acid, performic acid, permonosulphuric acid, their salts, in particular the salt of permonosulphuric acid, and their mixtures.

According to another advantageous embodiment, the pH of the pulp is adjusted to a pH higher than or equal to 3 during the adjustment stage of the pH (b). The pH is preferably adjusted between 4 and 12 and in a particularly preferred manner between 7 and 12, respectively 10 and 12.

According to the process of the invention, it can be important not to carry out a washing stage between the acid treatment stage (a) and the pH adjustment stage (b).

The fact that the chelation is rendered insensitive to variations in pH makes it possible to optimize the delignification and bleaching process. The liquors of the oxidation stage (d) can be recycled and can be added directly to the acid suspension in order to adjust the pH of the latter. It is naturally also possible to use other alkaline liquors available on site. As the process is not sensitive to variations in pH, it is not necessary to monitor closely the evolution of the pH during the adjustment stage of the pH (b). The residual oxidizing reagents such as ozone, hydrogen peroxide or the peracids contained in this liquor can act on the pulp. The effectiveness of the process is consequently improved.

It is not recommended to add, during the pH adjustment stage (b), alkaline-earth metal ions, in particular magnesium and calcium ions.

An additional washing stage of the pulp can be carried out after the adjustment stage of the pH (b) and before the addition of the chelating agent, if necessary.

It is possible, if it is desired, to insert one or more additional treatment stages of the pulp between the washing stage (c) and the treatment stage with an oxidizing agent (d).

By additional treatment stage of the pulp is meant alkaline extractions, in some cases reinforced with oxygen, or else treatments with chlorine, with chlorine dioxide or with their mixtures.

The chelating agent can be chosen from among aminocarboxylic acids, hydrocarboxylic acids, phosphonic acids and their salts.

There may be used as the chelating agent ethylenediaminetetra-acetic acid (EDTA), diethylenetriaminepenta-acetic acid (DTPA), citric acid, lactic acid, tartaric acid, aldonic acids, uronic acids, diethylenetriaminepentamethylene-phosphonic acid (DTMPA), the salts of these acids and/or their mixtures.

The temperature and the duration of the chelation are not critical in principle.

According to a first alternative of the process of the invention, an aminocarboxylated chelating agent is used in a quantity lower than 0.4% by weight in relation to the dry pulp.

This first alternative makes it possible to monitor the profile of the metal ions in the pulp with a reduced quantity of chelating agents and therefore to use much less chelating agent than in conventional processes for bleaching chemical pulp.

One advantage of this first alternative lies in the fact that the quantity of chelating agents discharged with the effluents into rivers is smaller compared with traditional processes. In practice, these traditional processes in fact require twice as much chelating agents in order to achieve the same results. The risk to the environment caused by the solubilisation of heavy metals from the sediments of river beds is consequently reduced to a minimum, as the quantity of chelating agents involved is smaller.

The fact that in the first alternative an acid treatment stage (a) aimed at reducing the quantity of hexene uronic acids in the pulp is combined with an adjustment of the pH before the washing of the pulp makes it possible to reduce significantly the quantity of chelating agents used. The quantity is advantageously lower than or equal to 0.3%, in particular to 0.2% by weight in relation to the dry pulp.

In the first alternative there may be used as the chelating agent ethylenediaminetetra-acetic acid (EDTA) and diethylenetriaminepenta-acetic acid (DTPA).

According to a second alternative of the process of the invention, a biodegradable chelating agent is used. This second alternative makes it possible to monitor the profile of the metal ions in the pulp without having to make use of chelating agents which are biodegradable only with difficulty, if at all.

As a result of this second alternative, it is now possible to use biodegradable chelating agents which have weaker chelating properties and which would have been ineffective in conventional processes for bleaching chemical pulp. The term "biodegradable chelating agent" is understood to mean a chelating agent that can be broken down by living organisms.

The ability, in the second alternative, to use chelating agents possessing weaker sequestrating properties reduces the risk that heavy metals contained in the sediments of river beds might be solubilised and introduced into the food chain, since their affinity for the heavy metals is weaker.

As these chelating agents are more easily biodegradable than EDTA or DTPA, the risk that these sequestrating agents might be discharged into rivers together with the effluents from pulp manufacture is very small, because these effluents are treated and the biodegradable chelating agents are destroyed in treatment stations before being discharged into rivers. Any risk to the environment in connection with the solubilisation of heavy metals form sediments in the river beds is thus ruled out.

One of the surprising aspects of the second alternative is that the optimal pH during the treatment with the chelating agent and more precisely the optimal pH of the pH adjustment stage is situated towards the alkaline zone where the buffer capacity of the pulp suspension is higher which facilitates the monitoring of the pH during the process considerably with regard to the known processes.

The fact that in the second alternative an acid treatment stage (a) aimed at reducing the quantity of hexene uronic acids in the pulp is combined with an adjustment of the pH before the washing of the pulp makes it possible to use weaker chelating agents, which are consequently more easily biodegradable. In addition, it is possible in this way to move the optimal pH range during the treatment with a chelating agent and more precisely the optimal pH of the pH adjustment step towards the alkaline zone where the buffer capacity of the pulp suspension is higher which facilitates the control of the pH during the conduct of this process as compared to the known processes.

With advantage, the second alternative enables the liquors obtained from a pulp bleaching and delignification stage, which have a high content of oxidized particles of carbohydrates, to be used directly or indirectly as a source of biodegradable chelating agents.

The liquors of the oxidation stage (d) can be recycled and can be added directly to the acid suspension in order to adjust the pH of the latter. It is naturally also possible to use other alkaline liquors available on site. As the process shifts the optimal range of pH of the adjustment stage of the pH towards the alkaline range, where the buffer capacity of the pulp suspension is higher, it is not necessary to monitor closely the evolution of the pH during the pH adjustment stage (b). The residual oxidizing reagents such as ozone, hydrogen peroxide or the peracids contained in this liquor can act on the pulp. The effectiveness of the process is consequently improved. The pH adjustment stage (b) may be combined in an advantageous manner with the use of oxidizing agents such as oxygen and hydrogen peroxide in an alkaline medium.

An additional washing stage of the pulp can be carried out, if necessary, after the pH adjustment stage (b) and before the addition of the biodegradable chelating agent.

There may be used, in the second alternative, as the biodegradable chelating agent N,N-bis(carboxymethyl) glycine (NTA), citric acid, lactic acid, tartaric acid, polyhydroxyacrylic acids, aldonic acids, gluconic acid, glucoheptonic acid, uronic acids, iduronic acid, galacturonic acid, mannuronic acid, pectines, alginates and gums, isoserine diacetic acid (ISDA), diethanoglycine (DEG), the salts of these acids and/or their mixtures. The preferred chelating agents are the polyhydroxycarboxylic acids containing one single carboxylic group.

The oxidizing agent of the treatment stage with an oxidizing agent (d) is chosen with advantage from among hydrogen peroxide, peracids and ozone.

Hydrogen peroxide in an alkaline medium is preferably used, either under conventional conditions or at elevated temperature and pressure.

The addition of the chelating agent after the pH adjustment stage (b) can be combined with a treatment of the pulp with oxygen if this is necessary. This treatment stage of the pulp with oxygen can be in the form of an O, Op, Eo, Eop stage in which O represents a stage with oxygen under pressure, Op a stage with oxygen reinforced with hydrogen peroxide under pressure, Eo an alkaline extraction stage reinforced with oxygen, Eop an extraction stage reinforced with oxygen and hydrogen peroxide.

The acid treatment stage aimed at reducing the quantity of hexene uronic acids present in the pulp is to permit the removal of a sizeable fraction of the hexene uronic groups, that is to say at least 10% of them. The quantity of hexene uronic acids is generally reduced by at least 15%, in particularly at least 20%. Reduced quantities by at least 25%, especially by at least 30% are preferred. Particularly favourable results are obtained with reduced quantities by at least 35%, in particular 40%. Reduced quantities by at least 50% are particularly preferred.

The pulp is treated in the presence of water with a consistency of 0.1 to 50% by weight and preferably from 1 to 20% by weight.

The process in accordance with the invention can be used in delignification and bleaching sequences aimed at reducing the quantity of elemental chlorine, bleaching sequences free from elemental chlorine (ECF) or sequences totally free from chlorine (TCF) or else in sequences aimed at minimizing the consumption of water e.g. by recycling of the effluents. It makes it possible, in these types of sequences, to attain more easily the objective of reducing the quantity of chlorine or chlorine dioxide in order to arrive at one and the same level of whiteness.

According to another aspect of the present invention, a process for the delignification and bleaching of chemical pulp is presented comprising the stages: A(Q) N(Q) W P, in which stage A represents a treatment stage of the pulp with acid aimed at reducing the quantity of hexene uronic acids, N represents an adjustment stage of the pH in order to deposit or to redeposit the ions of alkaline-earth metals on the pulp, (Q) represents the addition of a chelating agent which is undertaken before or during stage A and/or before, during or after the pH adjustment stage N, W represents a washing stage of the pulp and P represents an oxidation stage.

This process is particularly well suited to oxidizing agents sensitive to transition metals. By oxidizing agents sensitive to transition metals is meant reagents which decompose on contact with transition metals, such as hydrogen peroxide, peracids and ozone.

Other variants of the process for the delignification and bleaching of pulp with oxidizing agents comprise the stages

A N Q W P;

A N W Q W P;

Q A N W P;

A Q N W P;

A N Q O W P;

A N W Q O W P;

Q A N W D W P in which A, N, W, O and P have the meanings given above and D represents a treatment stage with chlorine dioxide.

It should be noted that the present process for the delignification and bleaching of pulp can be combined with any other conventional bleaching stage including with stages employing enzymes or chlorinated reagents such as chlorine and chlorine dioxide.

All the types of wood used for the production of chemical pulps are suitable for the implementation of the present process and in particular those used for kraft pulps, namely softwoods such as e.g. the various kinds of pines and deals and hardwoods such as e.g. birch, beech, oak, hornbeam and eucalyptus.

Other characteristics of the invention are described in a non-limiting way in the examples.

FIG. 1 shows the whiteness expressed in degrees ISO of a pulp subjected to an A N Q W P treatment and that of a pulp having undergone a conventional Q W P treatment, i.e. with neither treatment with acid nor neutralization.

In this figure, it is seen that if the pulp has been subjected to an A N Q W P treatment, the whiteness in degrees ISO after treatment with hydrogen peroxide remains constant in a pH range of the chelation Q of between 4 and 10. If the pulp has been subjected to a conventional Q W P treatment, the whiteness in degrees ISO declines rapidly when the optimum pH is exceeded. In this particular case, the optimum pH is equal to 4.

Figure 2:
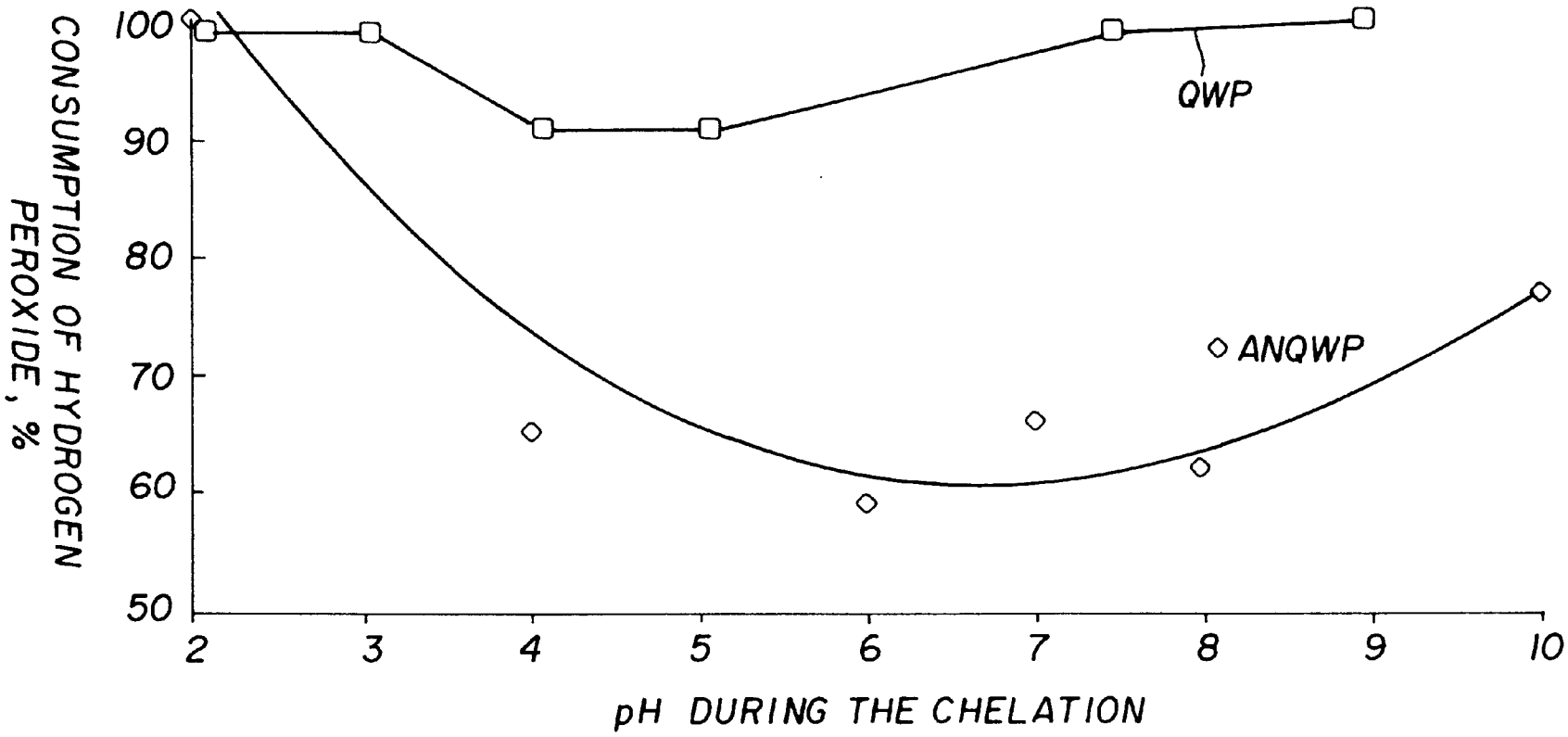
FIG. 2 is a graph showing the consumption of hydrogen peroxide as a function of the pH during the chelation of a pulp subjected to an A N Q W P treatment or else to a Q W P treatment.

FIG. 2 shows the consumption of hydrogen peroxide as a function of the pH during the chelation of a pulp subjected to an A N Q W P treatment or else to a Q W P treatment. In the case of a Q W P treatment, the consumption of hydrogen peroxide is higher and passes through a minimum which lies between pH 4 and 6. In the case of an A N Q W P treatment, the consumption of hydrogen peroxide is lower. In addition, the consumption of hydrogen peroxide remains at a lower value for pH values of between 4 and 10 during the chelation.

Treatment of the pulp according to the present process therefore makes it possible to obtain pulps having better visual and mechanical properties, and with a reduction in the consumption of hydrogen peroxide.

Figure 3:
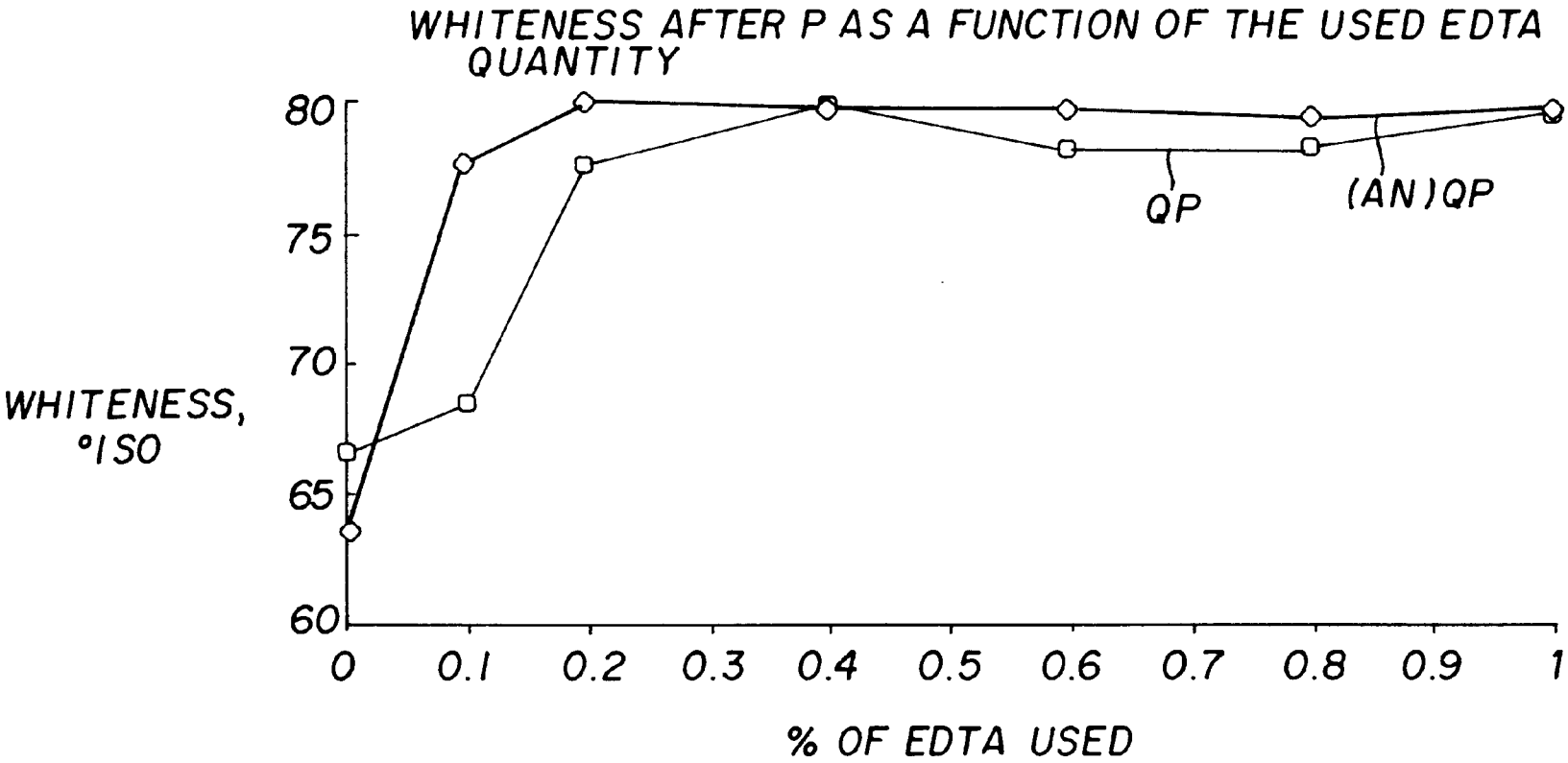
FIG. 3 is a graph showing the whiteness expressed in degrees ISO of a pulp subjected to an A N Q W P treatment and that of a pulp having undergone a conventional Q W P treatment.

FIG. 3 shows the whiteness expressed in degrees ISO of a pulp subjected to an A N Q W P treatment and that of a pulp having undergone a conventional Q W P treatment, i.e. with neither treatment with acid nor neutralization depending on the quantity of EDTA.

In this figure, it is seen that if the pulp has been subjected to an A N Q W P treatment, a whiteness in degrees ISO after treatment with hydrogen peroxide of 77.6 can be achieved with 0.1% of EDTA. The ISO whiteness reaches its maximum value of about 80 degrees ISO when 0.2% of EDTA is used, and remains constant with higher EDTA contents.

In contrast, if the pulp has been subjected to a conventional Q W P treatment, a whiteness of around 80 degrees ISO is achieved only when 0.4% of EDTA is used. With weaker concentrations, the whiteness obtained is less.

Figure 4:
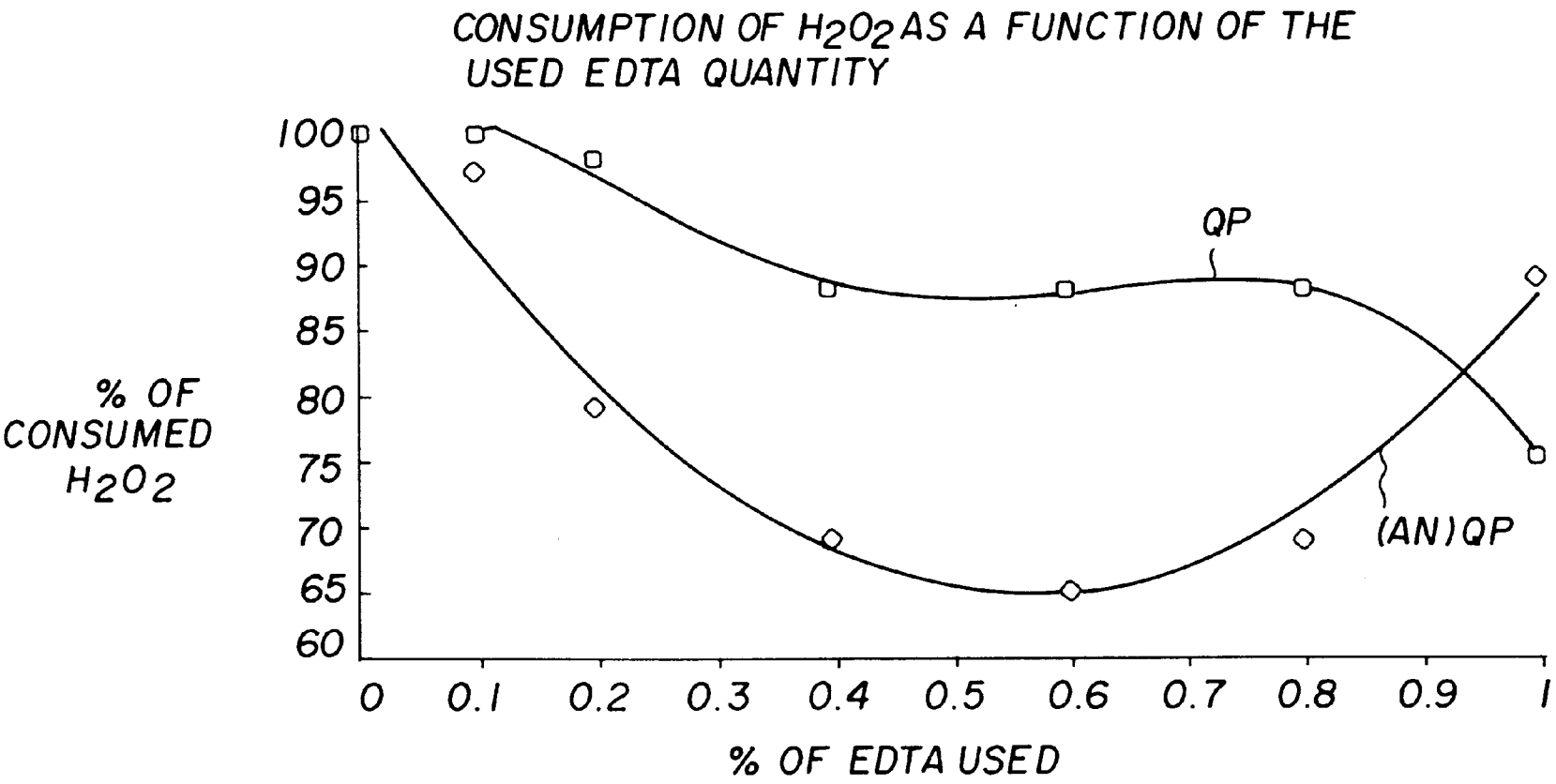
FIG. 4 is a graph showing the consumption of hydrogen peroxide as a function of the quantity of EDTA used during each chelation of a pulp subjected to an A N Q W P treatment or else to Q W P treatment.

FIG. 4 shows the consumption of hydrogen peroxide as a function of the quantity of EDTA used during the chelation of a pulp subjected to an A N Q W P treatment or else to a Q W P treatment. In the case of a Q W P treatment, the consumption of hydrogen peroxide is higher and reaches its minimum value when 1% of EDTA is added to the pulp at pH=4.

In the case of an A N Q W P treatment, the consumption of hydrogen peroxide is lower and passes through a minimum when the quantity of EDTA used is 0.6% and when the pH of the chelation is equal to 6. Even with quantities of EDTA less than or equal to 0.2% substantial economies in hydrogen peroxide can be made.

EXAMPLE 1

A pulp of hardwoods having an initial pH of 10.5 and a consistency of 37.6% by weight was subjected to an A N Q W P delignification and bleaching treatment.

The results of these tests are given in Table 1 below. The concentrations in $H_2O_2$, NaOH and EDTA are expressed in wt % with respect to the weight of dry matter in the pulp. It is possible to obtain a high and constant whiteness in degrees ISO for a particular pulp by carrying out a chelation in a pH range of between 4 and 12. Various samples of a particular pulp (consistency=12%) were in fact subjected to an acid treatment at a pH of 3 for 120 minutes at 110° C. and the pulp was then neutralized (pH=7). The consistency of the samples was adjusted to 4% and an identical quantity of EDTA was added to each sample and acted at 30° C. for 30 minutes. The chelation was conducted at pH values varying between 2 and 10. After washing of the pulp in order to remove the chelated metal ions, the pH of the samples was adjusted to pH=12, then the samples were subjected to a treatment with hydrogen peroxide for 120 minutes at 90° C., after which the density of the pulp was adjusted to 12% by wt.

It was found that the whiteness in degrees ISO of the pulps treated in this way remained more or less constant for pH values of the chelation of between 4 and 12.

The same pulp was subjected to a conventional Q W P treatment which did not include the acid stage and the prior neutralization. The results of these tests are given in Table 2 below.

For this bleaching process, a result was obtained, that is to say an optimal whiteness of 79.5 degrees ISO, when the chelation was carried out at a pH of 4. For different values of the pH, the whiteness in degrees ISO declined rapidly.

Similarly, the consumption of hydrogen peroxide increased significantly as soon as the optimum pH of 4 was departed from.

TABLE 1

Effect of A N Q W P treatment on the whiteness in degrees ISO and on the consumption of $H_2O_2$

| Stages | $H_2O_2$ | $H_2SO_4$ | NaOH | EDTA | T (° C.) | Time (min) | Density | pH ini. | pH fin | Cons, (% $H_2O_2$) | Cons, (% NaOH) | Whitness ISO |
|---|---|---|---|---|---|---|---|---|---|---|---|---|
| A | | pH 3 | | | 110 | 120 | 12 | 3.0 | 7.0 | | | |
| N | | pH 7 | | | 110 | 30 | 12 | | 6.5 | | | 51.6 |
| Q | | pH 2 | | 1 | 30 | 30 | 4 | | 2.1 | | | |
| P | 2 | | 1.5 | | 90 | 120 | 12 | 11.3 | 11.4 | 100 | 71 | 69.9 |
| Q | | pH 4 | | 1 | 30 | 30 | 4 | | 4.2 | | | |
| P | 2 | | 1.5 | | 90 | 120 | 12 | 11.5 | 10.8 | 65 | 67 | 79.7 |
| Q | | pH 6 | | 1 | 30 | 30 | 4 | | 5.8 | | | |
| P | 2 | | 1.5 | | 90 | 120 | 12 | 11.6 | 10.9 | 59 | 60 | 79.7 |
| Q | | pH 7 | | 1 | 30 | 30 | 4 | | 7.0 | | | |
| P | 2 | | 1.5 | | 90 | 120 | 12 | 11.6 | 11.0 | 66 | 60 | 79.8 |
| Q | | pH 8 | | 1 | 30 | 30 | 4 | 7.9 | | | | |
| P | 2 | | 1.5 | | 90 | 120 | 12 | 11.7 | 11.0 | 62 | 59 | 79.7 |
| Q | | pH 10 | | 1 | 30 | 30 | 4 | | 10.2 | | | |
| P | 2 | | 1.5 | | 90 | 120 | 12 | 11.6 | 11.1 | 77 | 59 | 79.4 |

TABLE 2

Effect of the pH of the chelation Q on the ISO whiteness and on the consumption of hydrogen peroxide $H_2O_2$

| | $H_2O_2$ | $H_2SO_4$ | NaOH | EDTA | T (° C.) | Time (min) | Density (%) | pH final | Cons, (% $H_2O_2$) | Cons, (% NaOH) | Whitness ISO |
|---|---|---|---|---|---|---|---|---|---|---|---|
| Q | | pH 2 | | 1 | 30 | 30 | 4 | 2.1 | | | |
| P | 2 | | 1.5 | | 90 | 120 | 12 | | 99 | 67 | 69.7 |
| Q | | pH 3 | | 1 | 30 | 30 | 4 | 3.1 | | | |
| P | 2 | | 1.5 | | 90 | 120 | 12 | | 99 | 61 | 72.4 |
| Q | | pH 4 | | 1 | 30 | 30 | 4 | 4.1 | | | |
| P | 2 | | 1.5 | | 90 | 120 | 12 | | 61 | 58 | 79.5 |
| Q | | pH 5 | | 1 | 30 | 30 | 4 | 5.1 | | | |
| P | 2 | | 1.5 | | 90 | 120 | 12 | | 91 | 45 | 76.2 |
| Q | | pH 7 | | 1 | 30 | 30 | 4 | 7.5 | | | |
| P | 2 | | 1.5 | | 90 | 120 | 12 | | 99 | 47 | 74.4 |
| Q | | pH 9 | | 1 | 30 | 30 | 4 | 9.0 | | | |
| P | | | 1.5 | | 90 | 120 | 12 | | 100 | 35 | 71.9 |

EXAMPLE 2

A pulp having an initial pH of 10.5 and a consistency of 37.6% by weight, a whiteness of 48.2° ISO and a kappa index of 11.2, was subjected to an A N Q W P delignification and bleaching treatment.

The results of these tests are given in Table 3 below. In order to simplify the presentation of the results, the washing stage W, which was carried out before the treatment of the pulp with oxidizing agent, is not shown in the table.

It is possible to obtain a high whiteness in degrees ISO for a particular pulp by subjecting the pulp to an A N Q W P treatment and using very little chelating agent. Various samples of a particular pulp (density=12%) were in fact subjected to an acid treatment at a pH of 3 for 120 minutes at 110° C. and the pulp was then neutralized (pH=7). The density of the samples was adjusted to 4% and a different quantity of EDTA was added to each sample and acted at 30° C. for 30 minutes. The chelation was conducted at pH 5.5–6. After washing of the pulp in order to remove the chelated metal ions, the pH of the samples was adjusted to pH=12, then the samples were subjected to a treatment with hydrogen peroxide for 120 minutes at 90° C., after which the density of the pulp was adjusted to 12% by wt.

It was found that the whiteness in degrees ISO of the pulps treated in this way remained essentially constant for quantities of EDTA greater than 0.1%.

The same pulp was subjected to a conventional Q W P treatment which did not include the acid stage and the prior neutralization. The chelation stage with variable quantities of EDTA was carried out at pH=4. The results of these tests are given in Table 4 below. In order to simplify the presentation of the results, the washing stage W, which was carried out before the treatment of the pulp with oxidizing agent, is not shown in the table.

For this bleaching process, it was found that a maximum whiteness of 79.8° ISO is achieved when 0.4% of EDTA is added to the pulp. With EDTA concentrations below 0.4%, the whiteness in degrees ISO declined rapidly.

TABLE 3

Results of pulp delignification and bleaching tests in accordance with an A N Q W P process, using different concentrations of EDTA

| 1 | 2 | 3 | 4 | pH | EDTA (%) | T (° C.) | t (min.) | Density % | pH final | $H_2O_2$ | Whitness (° ISO) |
|---|---|---|---|---|---|---|---|---|---|---|---|
| A | | | | 3 | | 110 | 120 | 12 | | | |
| | N | | | 7 | | 110 | 30 | 12 | | | |
| | | Q | | 5.5–6 | 0 | 30 | 30 | 4 | | | |
| | | | P | | | 90 | 120 | 12 | 11.5 | 100 | 63.5 |
| A | | | | 3 | | 110 | 120 | 12 | | | |
| | N | | | 7 | | 110 | 30 | 12 | | | |
| | | Q | | 5.5–6 | 0.1 | 30 | 30 | 4 | | | |
| | | | P | | | 90 | 120 | 12 | 11.0 | 97 | 77.6 |
| A | | | | 3 | | 110 | 120 | 12 | | | |
| | N | | | 7 | | 110 | 30 | 12 | | | |
| | | Q | | 5.5–6 | 0.2 | 30 | 30 | 4 | | | |
| | | | P | | | 90 | 120 | 12 | 10.6 | 79 | 79.9 |
| A | | | | 3 | | 110 | 120 | 12 | | | |
| | N | | | 7 | | 110 | 30 | 12 | | | |
| | | Q | | 5.5–6 | 0.4 | 30 | 30 | 4 | | | |
| | | | P | | | 90 | 120 | 12 | 10.7 | 69 | 79.6 |
| A | | | | 3 | | 110 | 120 | 12 | | | |
| | N | | | 7 | | 110 | 30 | 12 | | | |
| | | Q | | 5.5–6 | 0.6 | 30 | 30 | 4 | | | |
| | | | P | | | 90 | 120 | 12 | 10.9 | 65 | 79.6 |
| A | | | | 3 | | 110 | 120 | 12 | | | |
| | N | | | 7 | | 110 | 30 | 12 | | | |
| | | Q | | 5.5–6 | 0.8 | 30 | 30 | 4 | | | |
| | | | P | | | 90 | 120 | 12 | 11.0 | 60 | 79.3 |

TABLE 4

Results of pulp delignification and bleaching tests in accordance with a Q W P process, using different concentrations of EDTA

| 1 | 2 | pH | EDTA (%) | T (° C.) | t (min.) | Density (%) | pH final | $H_2O_2$ | Whiteness (° ISO) |
|---|---|---|---|---|---|---|---|---|---|
| Q | | 4 | 0 | 30 | 30 | 4 | 3.8 | | |
| | P | | | 90 | 120 | 12 | 11.3 | 100 | 66.6 |
| Q | | 4 | 0.1 | 30 | 30 | 4 | 3.9 | | |
| | P | | | 90 | 120 | 12 | 11.5 | 100 | 68.4 |
| Q | | 4 | 0.2 | 30 | 30 | 4 | 4.0 | | |
| | P | | | 90 | 120 | 12 | 11.2 | 98 | 77.6 |

TABLE 4-continued

Results of pulp delignification and bleaching tests in accordance with a Q W P process, using different concentrations of EDTA

| 1 | 2 | pH | EDTA (%) | T (° C.) | t (min.) | Density (%) | pH final | $H_2O_2$ | Whiteness (° ISO) |
|---|---|---|---|---|---|---|---|---|---|
| Q | | 4 | 0.4 | 30 | 30 | 4 | 4.2 | | |
| | P | | | 90 | 120 | 12 | 10.8 | 88 | 79.8 |
| Q | | 4 | 0.6 | 30 | 30 | 4 | 3.8 | | |
| | P | | | 90 | 120 | 12 | 10.9 | 88 | 78.1 |
| Q | | 4 | 0.8 | 30 | 30 | 4 | 3.8 | | |
| | P | | | 90 | 120 | 12 | 11.0 | 90 | 78.2 |
| Q | | 4 | 1.0 | 30 | 30 | 4 | 4.0 | | |
| | P | | | 90 | 129 | 12 | 10.8 | 75 | 79.5 |

EXAMPLE 3

A pulp presenting an initial pH of 8.5, a consistency of 24.6% by weight a whiteness of 60.3 degrees ISO and a Kappa Indice of 5.4 was subjected to a conventional Q W P delignification and bleaching treatment and, by way of comparison, to an A N Q W P treatment.

The results of these tests are given in Table 5 below.

The first four tests were carried out using a traditional delignification and bleaching process comprising a chelation stage and an oxidation stage using hydrogen peroxide in an alkaline medium (Q W P).

The chelation was carried out at ambient temperature for 30 minutes at pH levels between pH 3 and pH 11.1% by weight of glucoheptanoate was used as the chelating agent.

Oxidation of the pulp with hydrogen peroxide was carried out in an alkaline medium at 90° C. for 120 minutes.

A pulp with a weak whiteness of around 70 degrees ISO was obtained

In the second series of four tests, samples of a particular pulp (density=12%) were subjected to an acid treatment at a pH of 3 for 120 minutes at 110° C. The density of the samples was adjusted to 4% and an identical quantity of glucoheptanoate was added to each sample and acted at 30° C. for 30 minutes. The chelation was conducted at pH values varying between 3 and 11. After washing of the pulp in order to remove the chelated metal ions, the pH of the samples was adjusted to pH=12, then the samples were subjected to a treatment with hydrogen peroxide for 120 minutes at 90° C., after which the density of the pulp was adjusted to 12% by wt.

It was found that the whiteness in degrees ISO of the pulps treated in this way was higher than that obtained by the QWP process and produced optimum values for the pH in stage Q of more than pH 9

TABLE 5

Comparison between a conventional delignification and bleaching process and a delignification and bleaching process using a biodegradable chelating agent.

| 1 | 2 | 3 | 4 | pH | gluco-heptanoate | T (° C.) | t (min.) | Density % | pH final | Whiteness (° ISO) |
|---|---|---|---|---|---|---|---|---|---|---|
| Q | | | | 3 | 1 | 30 | 30 | 4 | 2.9 | |
| | W | P | | | | 90 | 120 | 12 | | 70.7 |
| Q | | | | 6 | 1 | 30 | 30 | 4 | 6.3 | |
| | W | P | | | | 90 | 120 | 12 | | 70 |
| Q | | | | 9 | 1 | 30 | 30 | 4 | 8.9 | |
| | W | P | | | | 90 | 120 | 12 | | 70.8 |
| Q | | | | 11 | 1 | 30 | 30 | 4 | 11 | |
| | W | P | | | | 90 | 120 | 12 | | 69.9 |
| A | N | | | 3 | | 110 | 120 | 12 | | |
| | Q | | | 3 | 1 | 30 | 30 | 4 | 2.9 | |
| | | W | P | | | 90 | 120 | 12 | | 71.9 |
| A | N | | | 3 | | 110 | 120 | 12 | | |
| | Q | | | 9 | 1 | 30 | 30 | 4 | 9.2 | |
| | | W | P | | | 90 | 120 | 12 | | 75.9 |
| A | N | | | 3 | | 110 | 120 | 12 | | |
| | Q | | | 11 | 1 | 30 | 30 | 4 | 11 | |
| | | W | P | | | 90 | 120 | 12 | | 77.9 |

What is claimed is:

1. Process for the delignification and bleaching of chemical pulp comprising in this order:

a) an acid treatment stage of the pulp in order to reduce the quantity of hexene uronic acids present in the pulp by at least 10%, the acid treatment stage of the pulp being conducted at a pH of 2 to 6.5 and at a temperature of between 85° C. and 150° C., b) a pH adjustment stage of the pulp to a value of between 7 and 12 in order to deposit or redeposit ions of alkaline-earth metals on the pulp, by addition of an alkaline liquor and without addition of alkaline earth metal ions, c) a washing stage of the pulp, d) a treatment stage of the pulp with an oxidizing agent, together with at least one addition of a chelating agent to the pulp carried out before the acid treatment stage (a), during the acid treatment stage (a), before the pH adjustment stage (b), during the pH adjustment stage (b) or between the pH adjustment stage (b) and the washing stage (c), and wherein a washing stage between stages (a) and (b) is not carried out.

2. Process according to claim 1, wherein the acid treatment stage (a) of the pulp is conducted at a pH of about 2 to 6.5 in the presence of an oxidizing agent.

3. Process according to claim 2, wherein the oxidizing agent of the acid treatment stage (a) is selected from among chlorine, chlorine dioxide, ozone, peracids, hydrogen peroxide and their mixtures.

4. Process according to claim 1, wherein that an additional washing stage of the pulp is conducted after the pH adjustment stage (b) and before the addition of chelating agent.

5. Process according to claim 1, further comprising at least one additional treatment stages of the pulp inserted between the washing stage (c) and the treatment stage with an oxidizing agent (d).

6. Process according to claim 1, wherein the organic chelating agent is selected from the group consisting of aminocarboxylic acids, hydroxycarboxylic acids, phosphonic acids and their salts.

7. Process according to claim 6, wherein the chelating agent is selected from the group consisting of ethylenediaminetetra-acetic acid (EDTA), diethylenetriamine-penta-acetic acid (DTPA), citric acid, lactic acid, tartaric acid, aldonic acids, uronic acids, diethylenetriaminepentamethylenephosphonic acid (DTMPA), the salts of these acids and mixtures thereof.

8. Process according to claim 1, the oxidizing agent of the treatment stage with an oxidizing agent (d) is selected from the group consisting of hydrogen peroxide, peracids and ozone.

9. Process according to claim 8, wherein the oxidizing agent of the treatment stage with an oxidizing agent (d) comprises hydrogen peroxide in an alkaline medium.

10. Process according to claim 1, wherein the addition of the chelating agent after the pH adjustment stage (b) is combined with a treatment of the pulp with oxygen.

11. Process according to claim 1, wherein the pH during the treatment with a chelating agent is greater than 8.

12. Process according to claim 1, wherein an aminocarboxylated chelating agent is used in a quantity less than or equal to 0.2% by weight in relation to the dry pulp.

13. Process according to claim 12, wherein there is used as chelating comprises ethylenediaminetetra-acetic aced (EDTA) and diethylenetriamine-penta-acetic (DTPA), the salts of these acids and/or their mixtures.

14. Process according to claim 1, wherein a biodegradable chelating agent is used.

15. Process according to claim 14, wherein the pH of the pulp is adjusted to a pH of between 10 and 12 during the pH adjustment stage (b).

16. Process according to claim 14, wherein liquors issued from a bleaching stage or a delignification stage of pulp having a high content of oxidized carbohydrates fragments are used directly or indirectly as source of biodegradable chelating agents.

17. Process according to claim 14, wherein the biodegradable chelating agent is selected from the group consisting of N,Nbis(carboxymethyl)glycine (NTA), citric acid, lactic acid, tartaric acid, polyhydroxyacrylic acids, aldonic acids, gluconic acid, glucoheptonic acid, uronic acids, iduronic acid, galaturonic acid, mannuronic acid, pectines, alginates and gums, isoserine diacetic acid (ISDA), diethanoglycine (DEG), the salts of these acids and mixtures thereof.

* * * * *